US011076638B2

(12) United States Patent
Reevell

(10) Patent No.: US 11,076,638 B2
(45) Date of Patent: Aug. 3, 2021

(54) ELECTRICALLY OPERATED AEROSOL-GENERATING SYSTEM WITH MULTIPLECOMPONENT AEROSOL-GENERATING ARTICLE

(71) Applicant: Philip Morris Products S.A., Neuchatel (CH)

(72) Inventor: Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 379 days.

(21) Appl. No.: 16/306,206

(22) PCT Filed: May 26, 2017

(86) PCT No.: PCT/EP2017/062790
§ 371 (c)(1),
(2) Date: Nov. 30, 2018

(87) PCT Pub. No.: WO2017/211600
PCT Pub. Date: Dec. 14, 2017

(65) Prior Publication Data

US 2019/0208820 A1 Jul. 11, 2019

(30) Foreign Application Priority Data

Jun. 8, 2016 (EP) ..... 16173559

(51) Int. Cl.
*A24F 13/00* (2006.01)
*A24F 7/02* (2006.01)
(Continued)

(52) U.S. Cl.
CPC ..... *A24F 7/02* (2013.01); *A24D 1/20* (2020.01); *A24F 40/40* (2020.01); *A24F 40/20* (2020.01)

(58) Field of Classification Search
CPC ..... A24F 47/00
(Continued)

(56) References Cited

U.S. PATENT DOCUMENTS 5,183,062 A 2/1993 Clearman et al.
5,498,855 A 3/1996 Deevi et al.
(Continued)

FOREIGN PATENT DOCUMENTS

AU 2010324131 A1 6/2012
CN 105357994 A 2/2016
(Continued)

OTHER PUBLICATIONS

Combined Chinese Office Action and Search Report dated Dec. 25, 2020, in Chinese Patent Application No. 201780029989.0 (with English translation), 10 pages.
(Continued)

*Primary Examiner* — Phuong K Dinh
(74) *Attorney, Agent, or Firm* — Oblon, McClelland, Maier & Neustadt, L.L.P.

(57) ABSTRACT

An electrically operated aerosol-generating system is provided, including an aerosol-generating article including a tubular first component including a tubular first volatile substrate and an inner passage; a second component including a second volatile substrate, the second component configured to be received in the inner passage of the first component; and a main unit configured to receive the aerosol-generating article, the main unit including a first heating portion including one or more electric heaters, the one or more electric heaters being configured to heat the tubular first volatile substrate of the tubular first component
(Continued)

when the aerosol generating article is received by the main unit; and a second heating portion including one or more electric heaters, the one or more electric heaters being configured to heat the second volatile substrate of the second component when the aerosol generating article is received by the main unit.

15 Claims, 4 Drawing Sheets

(51) Int. Cl.
*A24D 1/20* (2020.01)
*A24F 40/40* (2020.01)
*A24F 40/20* (2020.01)

(58) Field of Classification Search
USPC ..... 131/328–329
See application file for complete search history.

(56) References Cited

U.S. PATENT DOCUMENTS

| | | | |
|---|---|---|---|
| 5,514,630 | A | 3/1996 | Willkens et al. |
| 5,816,263 | A | 10/1998 | Counts et al. |
| 8,342,184 | B2 | 1/2013 | Inagaki et al. |
| 2014/0366898 | A1 | 12/2014 | Monsees et al. |
| 2015/0189915 | A1 | 7/2015 | Liu |
| 2015/0208730 | A1 | 7/2015 | Li et al. |
| 2016/0135505 | A1* | 5/2016 | Li ..... A24F 47/008 131/329 |
| 2016/0309784 | A1 | 10/2016 | Silvestrini et al. |
| 2017/0095002 | A1 | 4/2017 | Silvestrini |

FOREIGN PATENT DOCUMENTS

| | | | |
|---|---|---|---|
| CN | 105473012 | A | 4/2016 |
| EA | 022685 | B1 | 2/2016 |
| EP | 2 904 915 | A1 | 8/2015 |
| JP | 2014-518095 | A | 7/2014 |
| WO | WO 03/095688 | A2 | 11/2003 |
| WO | WO 2011/063970 | A1 | 6/2011 |
| WO | WO 2013/022936 | A1 | 2/2013 |
| WO | WO 2013/034453 | A1 | 3/2013 |
| WO | WO 2014/047955 | A1 | 4/2014 |
| WO | WO 2014/139609 | A2 | 9/2014 |
| WO | WO 2015/091258 | A1 | 6/2015 |
| WO | WO 2015/197627 | A1 | 12/2015 |

OTHER PUBLICATIONS

International Search Report and Written Opinion dated Sep. 15, 2017 in PCT/EP2017/062790, filed May 26, 2017.
Decision to Grant dated Jun. 25, 2020 in corresponding Russian Patent Application No. 018145509/03(076044) (with English Translation), 19 pages.
Japanese Decision to Grant dated May 13, 2021 in corresponding Japanese Patent Application No. 2018-562073 (with English translation).

* cited by examiner

ELECTRICALLY OPERATED AEROSOL-GENERATING SYSTEM WITH MULTIPLECOMPONENT AEROSOL-GENERATING ARTICLE

CROSS-REFERENCE TO RELATED APPLICATIONS

This application is a U.S. national stage application of PCT/EP2017/062790, filed on May 26, 2017, which is based upon and claims the benefit of priority from European patent application no. 16173559.2, filed Jun. 8, 2016, the entire contents of each of which are incorporated herein by reference.

TECHNICAL FIELD

The present invention relates to an electrically operated aerosol-generating system. In particular, the present invention relates to an electrically operated aerosol-generating system comprising an aerosol-generating article comprising multiple components and a main unit.

DESCRIPTION OF THE RELATED ART

One type of electrically operated aerosol-generating system is a handheld electrically operated aerosol-generating system. Handheld electrically operated aerosol-generating systems typically comprise an aerosol-generating device or a main unit comprising a battery, control electronics and an electric heater for heating an aerosol-generating article designed specifically for use with the aerosol-generating device. In some examples, the aerosol-generating article comprises an aerosol-forming substrate, such as a tobacco rod or a tobacco plug. Aerosol-forming substrates, such as tobacco, typically comprise one or more volatile compounds that form an aerosol when heated inside the aerosol-generating device. The heater contained within the aerosol-generating device is inserted into or around the aerosol-forming substrate when the aerosol-generating article is inserted into the aerosol-generating device. In some electrically operated aerosol-generating systems, the aerosol-generating article may comprise a capsule containing an aerosol-forming substrate, such as loose tobacco.

It would be desirable to reduce the size of the existing aerosol-generating systems. It would be desirable to provide an aerosol-generating system that generates an improved aerosol. It would be desirable to enable a user to vary the sensorial experience when using an aerosol-generating system.

SUMMARY

According to a first aspect of the present invention, there is provided an electrically operated aerosol-generating system comprising an aerosol-generating article and a main unit. The aerosol-generating article is configured to be received by the main unit. The aerosol-generating article comprises: a tubular first component and a second component. The tubular first component comprises a tubular first volatile substrate and an inner passage, and the second component comprises a second volatile substrate. The second component of the aerosol-generating article is configured to be received in the inner passage of the tubular first component of the aerosol-generating article. The main unit comprises: a first heating portion comprising one or more electric heaters, and a second heating portion comprising one or more electric heaters. The one or more electric heaters of the first heating portion are arranged to heat the first volatile substrate of the tubular first component when the aerosol-generating article is received by the main unit. The one or more electric heaters of the second heating portion are arranged to heat the second volatile substrate of the second component when the aerosol-generating article is received by the main unit.

The second component of the aerosol-generating article may be movably receivable in the inner passage of the tubular first component. The second component may be configured to be movably received in the inner passage of the tubular first component. The second component of the aerosol-generating article may be slidable within the inner passage of the tubular first component. This may enable the second component to be moved relative to the first component. This may enable the length of the aerosol-generating article to be altered by sliding the second component through the inner passage of the tubular first component. In other words, the aerosol-generating article may be telescopic.

The second component may be movable with respect to the first component between a storage configuration, wherein the second component is fully received in the inner passage of the tubular first component, and a use configuration, wherein the second component is partially received in the inner passage of the first component. Typically 100% of the length of the second component is received in the inner passage of the tubular first component when the aerosol-generating article is in the storage configuration. Typically between 0% and 15% of the length of the second component is received in the inner passage of the tubular first component when the aerosol-generating article is in the use configuration.

In the storage configuration, the length of the aerosol-generating article is reduced. This may reduce the amount of space required to store the aerosol-generating article and may reduce the amount of packaging material required to package the aerosol-generating article. In the use configuration, the length of the aerosol-generating article is increased. This may increase the surface area to volume ratio of the article. This may increase the surface area of the volatile substrates that is exposed to heaters of the main unit and may improve heat transfer between the heaters and the aerosol-generating article.

BRIEF DESCRIPTION OF THE DRAWINGS

Embodiments in accordance with the present invention will now be described in detail, by way of example only, with reference to the accompanying drawings, in which.

DETAILED DESCRIPTION

Figure 1:
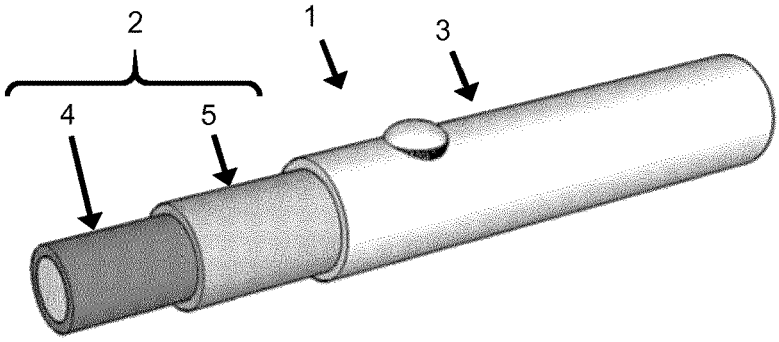
FIG. 1 is a schematic illustration of an electrically operated aerosol-generating system according to a first embodiment of the present invention.
Figure 2:
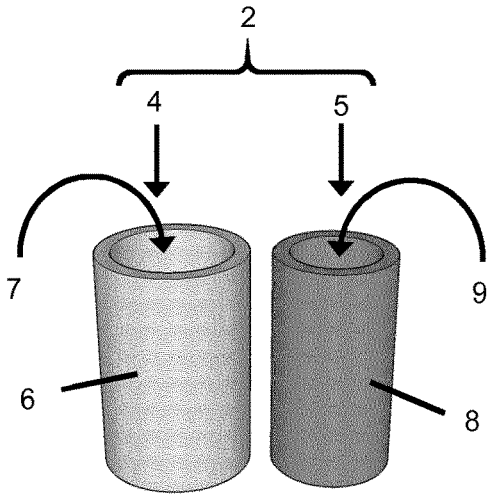
FIG. 2 is a schematic illustration of the aerosol-generating article of the electrically operated aerosol-generating system of FIG. 1, showing the tubular first component separate from the tubular second component.

As used herein, the term "aerosol-generating article" refers to an article comprising an aerosol-forming substrate that is intended to be heated rather than combusted in order to release volatile compounds that can form an aerosol. The aerosol formed by heating the aerosol-forming substrate may contain fewer known harmful constituents than would be produced by combustion or pyrolytic degradation of the aerosol-forming substrate.

As used herein, the term 'main unit' is used to describe a device that interacts with an aerosol-generating article to generate an aerosol. The main unit typically includes a supply of electrical energy and associated electric circuitry to operate the one or more heating elements.

As used herein, the term "volatile substrate" refers to an aerosol-forming substrate or a constituent part of an aerosol-forming substrate.

The first volatile substrate may be an aerosol-forming substrate or may be a constituent part of an aerosol-forming substrate, such as an aerosol-former or a nicotine source. The second volatile substrate may also be an aerosol-forming substrate or may be a constituent part of an aerosol-forming substrate, such as an aerosol-former or a nicotine source.

Where the first volatile substrate is a constituent part of an aerosol-forming substrate and the second volatile substrate is another constituent part of the aerosol-forming substrate, vapour from the heated first volatile substrate and vapour from the heated second volatile substrate combine to form an aerosol.

Separating constituents of an aerosol-forming substrate may enable reactive constituents to be held separately. This may substantially prevent or inhibit reactive constituents from reacting with each other before use of the aerosol-generating article. Separating constituents of the aerosol-forming substrate may also enable constituents to be heated to different temperatures. This may enable certain constituents to be heated to relatively high temperatures and other constituents to be heated to relatively low temperatures.

The first volatile substrate may be a first aerosol-forming substrate and the second volatile substrate may be a second aerosol-forming substrate. The composition of the first aerosol-forming substrate may be different to the composition of the second aerosol-forming substrate. This may enable the aerosol-generating system to provide a user with different sensorial experiences using the same article. The components may also be interchangeable, such that a user may choose different combinations of components to form the aerosol-generating article. However, in some embodiments, the first aerosol-forming substrate and the second aerosol-forming substrate have the same composition.

The main unit may comprises a mouth end and a distal end, opposite the mouth end. In preferred embodiments, the first heating portion and the second heating portion are coaxially aligned between the mouth end and the distal end.

As used herein, the term "mouth end" refers to a portion of the heated aerosol-generating article where aerosol exits the article and is delivered into a user's mouth. In use, a user may draw on the mouth end of the article in order to inhale aerosol generated by the heated aerosol-generating article.

As used herein, the term "distal end" refers to an end of the article that opposes the mouth end.

In some embodiments, the first heating portion of the main unit is arranged at an inner surface of the main unit. In such embodiments, the one or more electric heaters of the first heating portion may be configured to heat an outer surface of the tubular first component when the aerosol-generating article is received by the main unit.

The second heating portion of the main unit may also be arranged at an inner surface of the main unit. In such embodiments, the one or more electric heaters of the second heating portion may be configured to heat an outer surface of the second component when the aerosol-generating article is received by the main unit.

In some embodiments, the first heating portion of the main unit may be arranged at an inner surface of the main unit and the second heating portion of the main unit may be arranged at an inner surface of the main unit. The main unit may comprise a housing having a cavity configured to receive the aerosol-generating article. The one or more electric heaters of the first heating portion may be arranged on an inner surface of the cavity and the one or more electric heaters of the second heating portion may be arranged on an inner surface of the cavity.

As used herein, the terms 'inner' and 'outer' refer to relative positions of parts of the aerosol-generating article or the main unit.

As used herein, the term 'inner surface' refers to a surface of an article or a main unit that faces towards the interior of the article or main unit. For example, the inner passage of the aerosol-generating article may be defined by an inner surface. Likewise, the term 'outer surface' refers to a surface of an article or a main unit that faces towards the exterior or outwardly from the system. For example, the heating portion of the main unit is arranged at an outer surface of the main unit. As such, the one or more electric heaters are arranged at the outer surface of the main unit and may be visible to a user when an aerosol-generating article is not received on the heating portion of the main unit.

In some embodiments, the first heating portion of the main unit is arranged at an outer surface of the main unit. In such embodiments, the inner passage of the tubular first component may be configured to receive the first heating portion of the main unit and the one or more electric heaters of the first heating portion may be configured to heat an inner surface of the tubular first component.

In preferred embodiments, the second component of the aerosol-generating article is also a tubular component. The tubular second component may comprise a tubular second volatile substrate and an inner passage. In such embodiments, the tubular first component and the tubular second component may be arranged such that the inner passage of the tubular first component is coaxially aligned with the inner passage of the tubular second component.

In some preferred embodiments, the first heating portion of the main unit is arranged at an outer surface of the main unit and the second heating portion of the main unit is arranged at an outer surface of the main unit. In such embodiments, the inner passage of the tubular first component is configured to receive the first heating portion of the main unit and the one or more electric heaters of the first heating portion are configured to heat an inner surface of the tubular first component when the aerosol-generating article is received by the main unit. Similarly, the inner passage of the tubular second component is configured to receive the second heating portion of the main unit and the one or more electric heaters of the second heating portion are configured to heat an inner surface of the tubular second component when the aerosol-generating article is received by the main unit.

In such embodiments, the width of the inner passage of the tubular first component may be substantially similar to the width of the first heating portion of the main unit. As such, the inner surface of the inner passage may contact or abut the outer surface of the first heating portion of the main unit when the aerosol-generating article is received by the main unit. The width of the inner passage of the tubular second component may be smaller than the width of the first heating portion of the main unit, such that the aerosol-generating article is received by the main unit with a friction or an interference fit.

In such embodiments, the width of the inner passage of the tubular second component may be substantially similar to the width of the second heating portion of the main unit. As such, the inner surface of the inner passage may contact or abut the outer surface of the second heating portion of the main unit when the aerosol-generating article is received by the main unit. The width of the inner passage of the tubular second component may be smaller than the width of the second heating portion of the main unit, such that the aerosol-generating article is received by the heating portion with a friction or an interference fit.

As used herein, the term 'width' is used to describe the maximum dimension in the transverse direction of the aerosol-generating system, the aerosol-generating article and the main unit. When used herein, the term 'length' is used to describe the maximum dimension in the longitudinal direction of the aerosol-generating system, the aerosol-generating article and the main unit.

As used herein, the term 'longitudinal' is used to describe the direction between the proximal or mouth end and the distal end of the aerosol-generating system and the term 'transverse' is used to describe the direction perpendicular to the longitudinal direction.

In such preferred embodiments, the main unit may comprise one or more air passages. The one or more air passages may extend through the first and second heating portions of the main unit. The main unit may further comprise one or more air inlets in the outer surface of the main unit. One or more air inlets may be arranged at the first heating portion and one or more air inlets may be arranged at the second heating portion. The one or more air inlets may be arranged to receive vapour from the heated volatile substrates of the tubular components of the aerosol-generating article. The main unit may also comprise a mouthpiece. The mouthpiece may comprise one or more air outlets.

The one or more air passages of the main unit may extend between the one or more air inlets at the first and second heating portions and the one or more air outlets at the mouthpiece. As such, when a user draws on the mouthpiece of the main unit, air may be drawn into the one or more air passages through the one or more air inlets at the first and second heating portions and out of the air passages at the one or more air outlets.

The one or more air passages in the main unit may facilitate cooling of the vapour and aerosol generated from the heated aerosol-generating article. Providing the one or more air passages though the first and second heating portions of the main unit may eliminate the need for an additional cooling section at the proximal end of the system. This may reduce the overall length of the aerosol-generating system.

In other preferred embodiments, the electrically operated aerosol-generating system may further comprise a mouthpiece that is removably couplable to the main unit. The mouthpiece may comprise a housing having a cavity configured to receive the tubular first component and the tubular second component when the aerosol-generating article is received by the main unit and the mouthpiece is coupled to the main unit.

The cavity of the mouthpiece may comprise an air passage circumscribing the first and tubular second components of the aerosol-generating article when the aerosol-generating article is received by the main unit and the mouthpiece is coupled to the main unit. The air passage may be arranged to receiving vapour from the heated first volatile substrate and the heated second volatile substrate in use of the aerosol-generating system.

The mouthpiece may further comprise one or more air inlets. The mouthpiece may also comprise one or more air outlets. The one or more air passages may extend between the one or more air inlets and the one or more air outlets of the mouthpiece. As such, when a user draws on the mouthpiece, air may be drawn into the one or more air passages through the one or more air inlets and out of the air passages at the one or more air outlets.

The one or more air passages in the mouthpiece may facilitate cooling of the vapour and aerosol generated from the heated aerosol-generating article. Providing the one or more air passages in the cavity of the mouthpiece may eliminate the need for an additional cooling section at the proximal end of the system. This may reduce the overall length of the aerosol-generating system.

In other preferred embodiments of the present invention, the first heating portion is arranged at an inner surface of the main unit and the second heating portion is arranged at an inner surface of the main unit. In such embodiments, the one or more electric heaters of the first heating portion are configured to heat an outer surface of the tubular first component, and the one or more electric heaters of the second heating portion are configured to heat an outer surface of the tubular second component when the aerosol-generating article is received by the main unit.

In such preferred embodiments, the electrically operated aerosol-generating system may further comprise a mouthpiece. The mouthpiece may be removably couplable to the main unit. The mouthpiece may comprise a receiving member. The inner passage of the tubular first component may be configured to receive a first portion of the receiving member and the inner passage of the tubular second component may be configured to receive a second portion of the receiving member.

The width of the inner passage of the tubular first component may be substantially similar to the width of the first portion of the receiving member of the mouthpiece. As such, the inner surface of the inner passage of the tubular first component may contact or abut the outer surface of the first portion of the receiving member of the mouthpiece when the aerosol-generating article is received on the receiving member. The width of the inner passage of the tubular first component may be smaller than the width of the first portion of the receiving member of the mouthpiece, such that the tubular first component is received on the receiving member with a friction or an interference fit.

Similarly, the width of the inner passage of the tubular second component may be substantially similar to the width of the second portion of the receiving member of the mouthpiece. As such, the inner surface of the inner passage of the tubular second component may contact or abut the outer surface of the second portion of the receiving member of the mouthpiece when the tubular second component is received on the receiving member. The width of the inner passage of the tubular second component may be smaller than the width of the second portion of the receiving member, such that the aerosol-generating article is received on the receiving member with a friction or an interference fit.

The mouthpiece may comprise one or more air passages. The one or more air passages may extend through the receiving member. The mouthpiece may further comprise one or more air inlets in the receiving member. The one or more air inlets may be arranged at the first portion of the receiving member and one or more air inlets at the second portion of the receiving member. The one or more air inlets may be arranged to receive vapour from the heated volatile substrates of the aerosol-generating article. The mouthpiece may also comprise one or more air outlets. The one or more air passages of the mouthpiece may extend between the one or more air inlets at the first and second portions of the receiving member and the one or more air outlets. As such, when a user draws on the mouthpiece, air may be drawn into the one or more air passages through the one or more air inlets and out of the air passages at the one or more air outlets.

The one or more air passages in the mouthpiece may facilitate cooling of the vapour and aerosol generated from the heated aerosol-generating article. Providing the one or more air passages though the receiving member of the mouthpiece may eliminate the need for an additional cooling section at the proximal end of the system. This may reduce the overall length of the aerosol-generating system.

According to a second aspect of the present invention, there is provided an aerosol-generating article for an electrically operated aerosol-generating system according to the first aspect of the present invention. The aerosol-generating article comprises a tubular first component and a second component. The tubular first component comprises a tubular first volatile substrate and an inner passage. The second component comprises a second volatile substrate and the second component is configured to be received in the inner passage of the tubular first component.

The tubular configuration of the first component may facilitate improved conductive heat transfer from the one or more electric heaters of the first heating portion to the first volatile substrate. The tubular volatile substrate may have a larger surface area to volume ratio than a conventional body or a plug of equivalent size, without an inner passage. The tubular shape of the first volatile substrate may reduce the maximum thickness of the first volatile substrate. This may facilitate propagation of heat through the first volatile substrate. This may facilitate aerosol generation.

The tubular first component may be any suitable shape and size. The tubular first component may be substantially cylindrical. The tubular first component may be substantially elongate. The tubular first component may comprise a cylindrical open-ended hollow tube of the first volatile substrate. The tubular first component may have any suitable cross-section. For example, the cross-section of the tubular first component may be substantially circular, cylindrical, square or rectangular.

The tubular first component may have a width of between about 5 mm and about 20 mm, between about 5 mm and about 16 mm or about 13 mm.

The tubular first component may have a length of between about 5 mm and about 100 mm, or between about 10 mm and about 50 mm or about 25 mm.

The length of the tubular first component may be substantially similar to the length of the first heating portion of the main unit. The length of the tubular first component may be equal to or greater than the length of the first heating portion of the main unit such that tubular first component extends along the entire length of the first heating portion when the aerosol-generating article is received by the main unit.

The tubular first component comprises an inner passage. As used herein, the term 'inner passage' refers to a passage extending through at least part of a component. The inner passage may be surrounded by an annular body and may extend substantially along a longitudinal axis of the component.

The inner passage of the tubular first component may be any suitable shape and may have any suitable cross-section. For example, the cross-section of the inner passage may be substantially circular, cylindrical, square or rectangular.

The inner passage of the tubular first component may be arranged substantially centrally in the tubular first volatile substrate. As such, the thickness of the tubular first volatile substrate may be substantially consistent around the circumference of the tubular first component. This may enable even heating of the tubular first volatile substrate about the circumference of the tubular first component.

The inner passage of the tubular first component may have a width of between about 4 mm and about 18 mm, between about 4 mm and about 10 mm or about 9 mm.

The second component is configured to be received in the inner passage of the tubular first component. The second component may be movably received in the inner passage of the tubular first component. The second component may be slidably received in the inner passage of the tubular first component.

The second component may be any suitable shape and size to be received in the inner passage of the tubular first component. The second component may be substantially cylindrical. The second component may be substantially elongate. The second component may have any suitable cross-section. For example, the cross-section of the second component may be substantially circular, cylindrical, square or rectangular.

The second component may have a width of between about 4 mm and about 18 mm, between about 4 mm and about 10 mm or about 9 mm.

The width of the second component may be substantially similar to the width of the inner passage of the tubular first component. As such, the second component may contact or abut the inner surface of the inner passage of the tubular first component when the second component is received in the inner passage of the tubular first component. The width of the second component may be larger than the width of the inner passage of the tubular first component, such that the second component is received in the inner passage of the tubular first component with a friction or an interference fit.

The second component may have a length of between about 5 mm and about 100 mm, or between about 10 mm and about 50 mm or about 25 mm.

The length of the second component may be substantially similar to the length of the second heating portion of the main unit. The length of the second component may be equal to or greater than the length of the second heating portion of the main unit such that second component extends the entire length of the second heating portion when the aerosol-generating article is received by the main unit.

In some preferred embodiments, the second component may be a tubular component. The tubular second component may comprise a tubular second volatile substrate and an inner passage. The tubular second component may comprise a cylindrical open-ended hollow tube of the second volatile substrate.

The inner passage of the tubular second component may be shaped and arranged similarly to the inner passage of the tubular first component. The inner passage of the tubular second component may be configured to receive the second heating portion of the main unit. The inner passage of the second component may be configured to receive a second portion of a receiving member of a mouthpiece of the aerosol-generating system.

The inner passage of the tubular second component may have a width of between about 2 mm and about 14 mm, between about 2 mm and about 8 mm or about 5 mm.

An end plug may be provided in the inner passage of the tubular second component. The end plug may be arranged at the end of the second component that is remote from the tubular first component. The end plug may facilitate location of the aerosol-generating article on the main unit. The plug may be porous or air-permeable and may help to retain vapour in the aerosol-generating article.

In preferred embodiments, the tubular first component and the tubular second component are arranged such that the inner passage of the tubular first component is coaxially aligned with the inner passage of the tubular second component.

The aerosol-generating article comprises at least one aerosol-forming substrate. In some embodiments, the first volatile substrate may be a first aerosol-forming substrate and the second volatile substrate may be a second aerosol-forming substrate. In other embodiments, the first volatile substrate may be a first component of an aerosol-forming substrate and the second volatile substrate may be a second component of the aerosol-forming substrate. In such embodiments, vapour from the heated first volatile substrate and vapour from the heated second volatile substrate may be combined to form an aerosol. For example, the first volatile substrate may comprise a tobacco based material and the second volatile substrate may comprise an aerosol-former, such as glycerine.

The volatile substrates may be solid. The volatile substrates may be solid at room temperature. The volatile substrates may comprise a tobacco-containing material containing volatile tobacco flavour compounds which are released from the substrate upon heating. The volatile substrates may comprise a non-tobacco material. The volatile substrates may comprise tobacco-containing material and non-tobacco containing material.

The volatile substrates may comprise, for example, one or more of: powder, granules, pellets, shreds, strands, strips or sheets containing one or more of: herb leaf, tobacco leaf, tobacco ribs, expanded tobacco and homogenised tobacco.

The solid volatile substrates may contain tobacco or non-tobacco volatile flavour compounds, which are released upon heating of the solid volatile substrates.

The solid volatile substrates may be provided on or embedded in a thermally stable carrier. The carrier may take the form of powder, granules, pellets, shreds, strands, strips or sheets. The solid volatile substrates may be deposited on the entire surface of the carrier. The solid volatile substrates may be deposited in a pattern to provide a non-uniform flavour delivery during use.

The solid volatile substrates may comprise a gathered textured sheet of homogenised tobacco material. As used herein, the term 'sheet' refers to a laminar element having a width and length substantially greater than a thickness. As used herein, the term 'gathered' is used to describe a sheet that is convoluted, folded, or otherwise compressed or constricted substantially transversely to a longitudinal axis of the aerosol-generating article. As used herein, the term 'textured sheet' denotes a sheet that has been crimped, embossed, debossed, perforated or otherwise deformed. As used herein, the term 'homogenised tobacco material' refers to a material formed by agglomerating particulate tobacco.

The solid volatile substrates may comprises a gathered crimped sheet of homogenised tobacco material. As used herein, the term 'crimped sheet' refers to a sheet having a plurality of substantially parallel ridges or corrugations.

The solid volatile substrates may comprise one or more aerosol formers. The solid volatile substrates may comprise a single aerosol former. The solid volatile substrates may comprise two or more aerosol formers. The solid volatile substrates may have an aerosol former content of greater than about 5 percent on a dry weight basis. The solid volatile substrates may have an aerosol former content of between about 5 percent and approximately 30 percent on a dry weight basis. The solid volatile substrates may have an aerosol former content of about 20 percent on a dry weight basis.

As used herein, the term 'aerosol former' refers to any suitable known compound or mixture of compounds that, in use, facilitates formation of an aerosol and that is substantially resistant to thermal degradation at the operating temperature of the aerosol-generating article. Suitable aerosol-formers include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

The components may comprise one or more layers circumscribing the volatile substrates. For example, the components may comprise one or more wrappers wrapped around the volatile substrates.

The one or more layers may comprise a thermally insulating material. Wrapping a layer of thermally insulating material around the volatile substrate may facilitate retention of heat in the aerosol-generating article. As used herein the term 'thermally insulating material' is used to describe material having a bulk thermal conductivity of less than about 50 milliwatts per metre Kelvin (mW/(m·K)) at 23° C. and a relative humidity of 50% as measured using the modified transient plane source (MTPS) method. The thermally insulating material may also have a bulk thermal diffusivity of less than or equal to about 0.01 square centimetres per second (cm2/s) as measured using the laser flash method.

The one or more layers may comprise a material that is substantially impermeable to gases, such as air. Circumscribing the components with a layer of material that is substantially impermeable to gas may facilitate retention of vapour generated by the heated volatile substrates in the aerosol-generating system and may facilitate direction of the vapour towards the user.

The one or more layers may comprise any suitable material. The one or more layers may comprise a paper-like material. The one or more layers may comprise cigarette paper. The one or more layers may comprise tipping paper.

For tubular components, the inner passage of the tubular volatile substrate may be the inner passage of the component. However, in some embodiments, the tubular component may comprise one or more layers circumscribing the inner surface of the inner passage of the tubular volatile substrate. The one or more inner layers may comprise substantially the same material as described above in relation to the one or more outer layers.

According to a third aspect of the present invention, there is provided a main unit for an electrically operated aerosol-generating system according to any preceding claim. The main unit comprises a first heating portion comprising one or more electric heaters and a second heating portion comprising one or more electric heaters.

The main unit may comprise a housing. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. The material may be light and non-brittle. The main unit may comprise a proximal portion and a distal portion.

The proximal portion of the main unit comprises the first and second heating portions. As used herein, the term 'heating portion' is used to describe the portion of the main unit that comprises the one or more electric heaters. The extent of the heating portion is determined by the extent of the heaters over the outer surface of the main unit.

The first heating portion may have any suitable shape and dimensions. The first heating portion may be substantially cylindrical. The first heating portion may be substantially elongate. The first heating portion may have any suitable cross-section. For example, the cross-section of the first heating portion may be substantially circular, elliptical, square or rectangular.

The first heating portion may have a length of between about 5 mm and about 100 mm, or between about 10 mm and about 50 mm or about 25 mm.

In preferred embodiments, the first heating portion is arranged at an outer surface of the main unit. In such embodiments, the shape and dimensions of the first heating portion may be substantially similar to the shape and dimensions of the inner passage of the tubular first component. In such embodiments, the shape and dimensions of the first heating portion may be complementary to the shape of the inner passage of the tubular first component. The first heating portion may have a width of between about 4 mm and about 18 mm, between about 2 mm and about 10 mm or about 9 mm.

In other embodiments, the first heating portion may be arranged at an inner surface of the main unit. In such embodiments, the main unit may comprise a housing having a cavity and the first heating portion may be arranged at an inner surface of the cavity. In such embodiments, the shape and dimensions of the first heating portion may be substantially similar to the shape and dimensions of the tubular first component. In such embodiments, the shape and dimensions of the first heating portion may be complementary to the shape of the tubular first component. In such embodiments, the first heating portion may have a width of between about 5 mm and about 20 mm, between about 5 mm and about 16 mm or about 13 mm.

The second heating portion may also have any suitable shape and dimensions. The second heating portion may be substantially cylindrical. The second heating portion may be substantially elongate. The second heating portion may have any suitable cross-section. For example, the cross-section of the second heating portion may be substantially circular, elliptical, square or rectangular.

The second heating portion may have a length of between about 5 mm and about 100 mm, or between about 10 mm and about 50 mm or about 25 mm.

The second heating portion may be arranged at an inner surface of the main unit. In such embodiments, the main unit may comprise a housing having a cavity and the second heating portion may be arranged at an inner surface of the cavity. In such embodiments, the shape and dimensions of the second heating portion may be substantially similar to the shape and dimensions of the second component. In such embodiments, the shape and dimensions of the second heating portion may be complementary to the shape of the second component. In such embodiments, the second heating portion may have a width of between about 4 mm and about 18 mm, between about 4 mm and about 10 mm or about 9 mm.

In preferred embodiments, the second component of the aerosol-generating article is a tubular component having an inner passage. In such preferred embodiments, the second heating portion is arranged at an outer surface of the main unit. In such preferred embodiments, the shape and dimensions of the second heating portion may be substantially similar to the shape and dimensions of the inner passage of the tubular second component. In such embodiments, the shape and dimensions of the second heating portion may be complementary to the shape and dimensions of the inner passage of the tubular second component. The second heating portion may have a width of between about 2 mm and about 14 mm, between about 4 mm and about 8 mm or about 5 mm.

Each one of the first and second heating portions may comprise any suitable number of electric heaters. The heating portions may comprise one electric heater. The heating portions may comprise two or more electric heaters. The heating portions may comprise two, three, four, five, six, seven, eight or nine electric heaters. Where the heating portion comprises two or more electric heaters, the two or more electric heaters may be spaced around the circumference of the heating portion. The two or more electric heaters may be spaced along the length of the heating portion. Where the heating portion comprises three or more electric heaters, the three or more electric heaters may be spaced evenly across the heating portion. The three or more electric heaters may be spaced unevenly across the heating portion.

The one or more electric heaters of the second heating portion may be similar to the one or more electric heaters of the first heating portion. The one or more electric heaters of the second heating portion may be different to the one or more electric heaters of the first heating portion.

The electric heaters may be any suitable shape. The electric heaters may be elongate. The electric heaters may extend substantially the length of the heating portion. The electric heaters may be substantially annular. The electric heaters may comprise annular rings. The rings may substantially circumscribe a portion of the outer surface of the main unit. The rings may substantially circumscribe a portion of the proximal end of the heating portion. The rings may substantially circumscribe a portion of the distal end of the heating portion.

The electric heaters may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required. Examples of suitable composite heater elements are disclosed in U.S. Pat. No. 5,498,855, WO-A-03/095688 and U.S. Pat. No. 5,514,630.

The distal portion of the main unit may be any suitable shape and have any suitable dimensions. The distal portion may be substantially cylindrical. The distal portion may be substantially elongate. The distal portion may have any suitable cross-section. For example, the cross-section of the distal portion may be substantially circular, elliptical, square or rectangular. The distal portion may be configured to be held by a user during use of the aerosol-generating system.

The width of the distal portion of the main unit may be larger than the width of the proximal portion of the main unit. This may provide a larger space in the distal portion than in the proximal portion and may enable the distal portion to accommodate one or more power supplies and electric circuitry. The distal portion may have a width of between about 5 mm and about 30 mm, between about 5 mm and about 16 mm or about 13 mm. The distal portion may have a length of between about 10 mm and about 100 mm, or between about 10 mm and about 50 mm or about 45 mm.

The main unit may comprise a second shoulder between the proximal portion and the distal portion of the main unit. The second shoulder may connect the outer surface of the proximal portion of the main unit to the outer surface of the distal portion of the main unit. The second shoulder may comprise an angled, sloped or bevelled surface joining the proximal portion of the main unit and the distal portion of the main unit. The second shoulder may comprise a wall extending substantially radially outwards from the outer surface of the proximal portion of the main unit to the outer surface of the distal portion of the main unit.

The main unit may be configured to engage with the second component of the article when the article is received by the main unit. The main unit may be configured to engage with the second component of the article when the article is received by the main unit such that the second component may be moved relative to the first component by the main unit, to locate the first component adjacent to the first heating portion and the second component adjacent to the second heating portion.

The main unit may further comprise a distal stop. The distal stop may be arranged distal to the first and second heating portions of the main unit. The distal stop may be configured to engage with the distal end of the aerosol-generating article when the aerosol-generating article is received by the main unit. Where the main unit comprises a second shoulder between the proximal portion and the distal portion, the distal stop may be arranged between the first and second heating portions and the second shoulder.

The main unit may comprise one or more electric power supplies. The one or more electric power supplies may be arranged in the distal portion of the main unit. The one or more power supplies may comprise a battery. The battery may be a Lithium based battery, for example a Lithium-Cobalt, a Lithium-Iron-Phosphate, a Lithium Titanate or a Lithium-Polymer battery. The battery may be a Nickel-metal hydride battery or a Nickel cadmium battery. The one or more power supplies may comprise other forms of charge storage devices, such as capacitors. The one or more power supplies may require recharging and may be configured for many cycles of charge and discharge. The one or more power supplies may have a capacity that allows for the storage of enough energy for one or more user experiences; for example, the one or more power supplies may have sufficient capacity to allow for the continuous generation of aerosol for a period of around six minutes.

The main unit may comprise electric circuitry. The electric circuitry may comprise one or more microprocessors. The main unit may comprise electric circuitry configured to control the supply of power to the one or more electric heaters of the first and second heating portions from the one or more electrical power supplies.

Where a heating portion of the main unit comprises two or more electric heaters, the electric circuitry may be configured to supply power to all of the electric heaters of the heating portion simultaneously. Where the heating portion comprises two or more electric heaters, the electric circuitry may be configured to supply power to each electric heater separately. The electric circuitry may be configured to supply power to each electric heater selectively. The electric circuitry may be configured to supply power to the electric heaters sequentially. The electric circuitry may be configured to supply power to selected ones of the electric heaters in a predetermined sequence. For example, the electric circuitry may be configured to supply power to one heater per puff. In another example, the electric circuitry may be configured to supply power to a first heater for a predetermined period of time and subsequently to supply power to a second heater for a predetermined period of time. This may enable selective heating of portions of the volatile substrate. This may enable variation of the aerosol supplied to the user during a puff. This may enable portions of the volatile substrate to be heated to different temperatures. This may enable the aerosol-generating system to preserve unheated portions of volatile substrate for each puff of a user experience.

The main may comprise a user input, such as a switch or button. This may enable the user to switch the main unit on and off. The switch or button may initiate aerosol generation. The switch or button may activate the one or more electric heaters of the first heating portion and the one or more electric heaters of the second heating portion. The switch or button may prepare the electric circuitry to await input from a puff detector.

The electric circuitry may comprise a sensor or a puff detector to detect air flow through the aerosol-generating system indicative of a user taking a puff. The electric circuitry may be configured to provide supply power to the one or more electric heaters when the sensor senses a user taking a puff.

The system of the present invention may also comprise a mouthpiece for a user to draw on to receive aerosol generated by the aerosol-generating system. In some embodiments, the mouthpiece may be a part of the main unit. In other embodiments, the mouthpiece may be removably couplable to the main unit.

In embodiments where the first and second heating portions of the main unit are arranged at an outer surface of the main unit, the mouthpiece may comprise a housing having a cavity configured to receive the aerosol-generating article. In such embodiments, one or more air passage may be provide in the mouthpiece when the aerosol-generating article is received by the mouthpiece. The one or more air passages may be configured to receive vapour from the heated aerosol-generating article and to deliver the vapour to the user.

In embodiments where the first and second heating portions of the main unit are arranged at an inner surface of the main unit, the mouthpiece may comprise a receiving member. The receiving member may have a first portion configured to be received in the inner passage of the tubular first component. The receiving member may also have a second portion configured to be received in the inner passage of the tubular second component.

The receiving member may comprise one or more air passages. The one or more air passages may extend through the first and second portions of the receiving member. The receiving member may also comprise a one or more air inlets at the first portion and one or more air inlets at the second portion. The one or more air inlets may be arranged to be covered by the first and second components of the aerosol-generating article when the aerosol-generating article is received on the receiving member. The plurality of air inlets may enable vapour from the heated aerosol-generating article to be drawn into the air passage of the receiving member.

The receiving member may comprise one or more additional air inlets at the proximal end. The one or more additional air inlets may not be covered by the aerosol-generating article when the aerosol-generating article is received on the receiving member. The one or more air inlets may enable ambient air to be drawn directly into the air passage of the receiving member.

The mouthpiece may comprise any suitable means for removably coupling to the main unit. For example, the mouthpiece may comprise a screw thread or a bayonet connector and the main unit may comprise a complementary screw thread or bayonet connector engageable with the screw thread or bayonet connector of the mouthpiece.

Additional components may be provided in the mouthpiece. The mouthpiece may comprise a filter comprising a material of low or very low filtration efficiency. The mouthpiece may comprise one or more segments comprising absorbents, adsorbents, flavourants, and other aerosol modifiers and additives or combinations thereof. The mouthpiece may comprise a cooling element. The cooling element may comprise a plurality of longitudinally extending channels. The cooling element may comprise a gathered sheet of material selected from the group consisting of metallic foil, polymeric material, and substantially non-porous paper or cardboard.

When the electrically operated aerosol-generating system is assembled for use and the aerosol-generating article is received by the main unit, the aerosol-generating system may have a substantially cylindrical shape. The aerosol-generating system may have a total length of between about 70 mm and about 200 mm, or between about 70 mm and about 150 mm, or about 120 mm. The aerosol-generating system may have a width of between about 5 mm and about 20 mm, between about 5 mm and about 10 mm or about 8 mm.

The aerosol-generating article may be configured to be a disposable component. The aerosol-generating article may be configured to be disposed after a single user experience. In contrast, the main unit may be configured to be durable and reusable. The main unit may comprise relatively expensive and durable components of the aerosol-generating system, such as a power supply, heaters, and electric circuitry.

The aerosol-generating article may be manufactured, stored and sold separately from the main unit. Each aerosol-generating article may be individually packaged. A plurality of the aerosol-generating articles may be packaged and sold together.

An electrically operated aerosol-generating system according to a first embodiment of the present invention is shown in FIGS. 1 to 5. The electrically operated aerosol-generating system 1 comprises an aerosol-generating article 2 and a main unit 3.

The aerosol-generating article 2 comprises a tubular first component 4 and a tubular second component 5. The tubular first component 4 comprises a cylindrical open-ended hollow tube of a first aerosol-forming substrate 6. An inner passage 7 extends centrally through the length of the tubular aerosol-forming substrate 6, such that both ends of the inner passage 7 are open. Both open ends of the inner passage 7 are configured to receive the tubular second component 5.

The tubular body of aerosol-forming substrate 6 comprises one or more gathered sheets of tobacco circumscribed by an outer wrapper (not shown), which covers the cylindrical outer surface of the tubular body of aerosol-forming substrate 6. The outer wrapper is formed of a material that is permeable to gas, such that the outer wrapper enables vapour from the heated aerosol-forming substrate 6 to leave the tubular first component 4 via the cylindrical outer surface. The outer wrapper does not extend over the annular end faces of the tubular aerosol-forming substrate 6, such that the annular end faces of the tubular aerosol-forming substrate 6 are exposed to ambient air. Ambient air may be drawn into the tubular first component 4 through either annular end faces and through the cylindrical outer surface via the air permeable wrapper.

The tubular second component 5 is substantially similar to the tubular first component 4. The tubular second component 5 comprises a cylindrical open-ended hollow tube of a second aerosol-forming substrate 8 having an inner passage 9 extending centrally through the length of the tubular aerosol-forming substrate 8. The second aerosol-forming substrate has the same composition as the first aerosol-forming substrate. The length of the tubular second component 5 is substantially similar to the length of the tubular first component 4. However, the width of the tubular second component 5 is smaller than the width of the tubular first component 4. The width of the tubular second component 5 is substantially similar to the width of the inner passage 7 of the tubular first component 4. As such, the tubular second component 5 may be received in the inner passage 7 of the tubular first component 4 when the inner passage 9 of the tubular second component 5 and the inner passage 7 of the tubular first component 4 are coaxially aligned on a common axis A, as shown in FIGS. 3 and 4.

Figure 3:
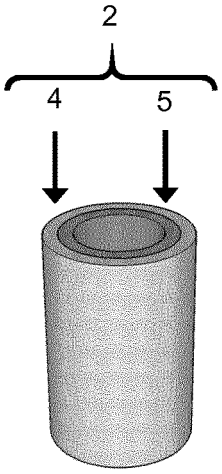
FIG. 3 is a schematic illustration of the aerosol-generating article of FIG. 2, showing the aerosol-generating article in the storage configuration, with the tubular second component fully received in the inner passage of the tubular first component.
Figure 4:
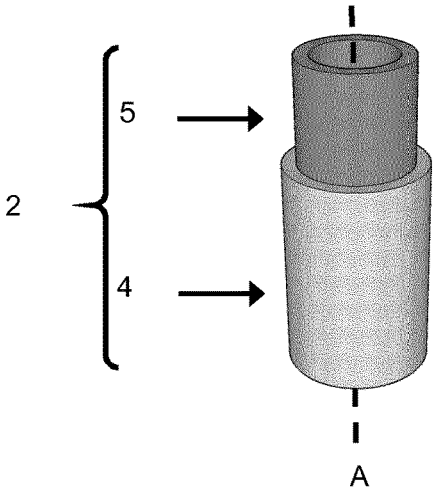
FIG. 4 is a schematic illustration of the aerosol-generating article of FIG. 2, showing the aerosol-generating article in the use configuration, with the tubular second component partially received in the inner passage of the tubular first component.

As the length of the tubular second component 5 is substantially similar to the length of the tubular first component 4, the tubular second component 5 may be fully received in the inner passage 7 of the tubular first component 4, as shown in FIG. 3. This configuration will be referred to as the storage configuration. In the storage configuration, the length of the aerosol-generating article 2 is reduced, which may be useful for storage and transport of the aerosol-generating article 2.

The tubular second component 5 may also slide through the inner passage 7 of the tubular first component 4. This may enable the tubular second component 5 to be moved through the inner passage 7 of the tubular first component 4 and out of the storage configuration.

The tubular second component 5 is received in the inner passage 7 of the tubular first component 4 with an interference or friction fit, such that a moderate force is required to move the tubular second component 5 through the inner passage 7 of the tubular first component 4. This substantially prevents or inhibits the tubular second component from sliding out of the inner passage 7 of the tubular first component 4 without a user applying a force to the tubular second component 5.

When the aerosol-generating article 2 is received by the main unit 3, as shown in FIG. 1, the tubular second component 5 is only partially received in the inner passage 7 of the tubular first component 4. This configuration will be referred to as the use configuration. In the use configuration, typically between 0% and 15% of the length of the tubular second component is received in the inner passage 7 of the tubular first component 4, as shown in FIG. 4.

Figure 5:
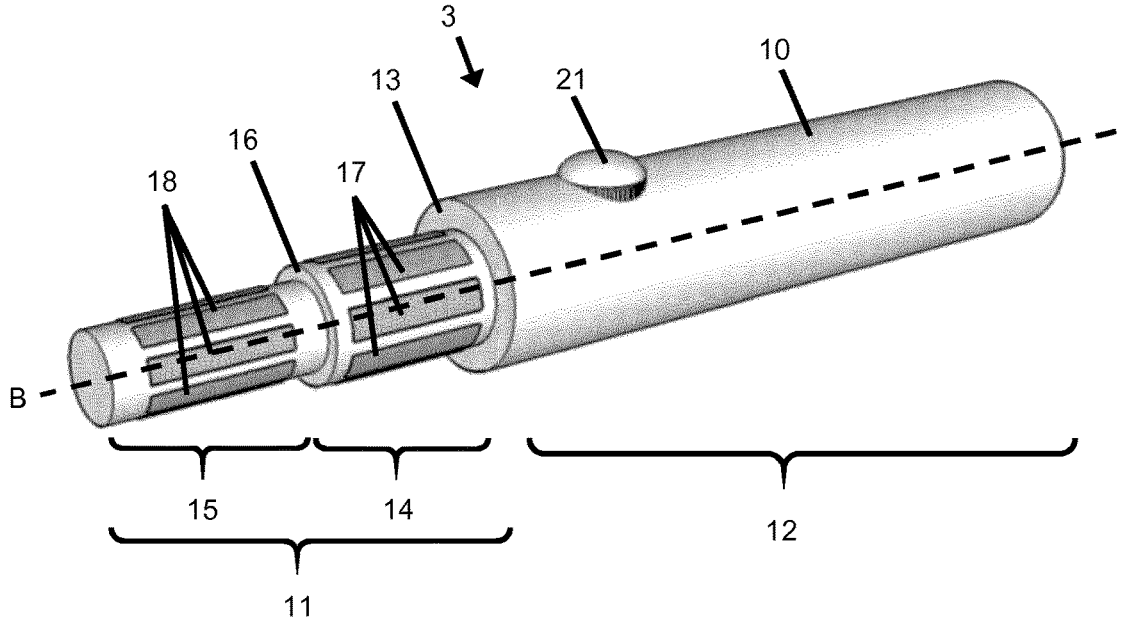
FIG. 5 is a schematic illustration of a main unit for the electrically operated aerosol-generating system of FIG. 1.

The main unit 3 is shown in FIG. 5. The main unit 3 comprises a substantially circularly-cylindrical hollow housing 10 formed of a rigid, thermally insulating material, such as PEEK. The main unit 3 comprises a proximal portion 11 and a distal portion 12 that are separated by a shoulder 13.

The proximal portion 11 comprises a first heating portion 14 and a second heating portion 15. The first and second heating portions 14, 15 extend over portions of the outer surface of the proximal portion 11. The second heating portion 15 is arranged at the proximal end of the main unit 3, and the first heating portion 14 is arranged between the second heating portion 15 and the shoulder 13.

The second heating portion 15, first heating portion 14 and distal portion 12 are coaxially arranged along a common axis B.

The width of the second heating portion 15 is less than the width of the first heating portion 14. As such, a first shoulder 16 is provided between the first heating portion 14 and the second heating portion 15. The first shoulder 16 comprises a wall extending substantially radially outwardly from the second heating portion 15. Similarly, the width of the first heating portion 14 is less than the width of the distal portion 12 of the main unit 3. As such, a second shoulder 13 is provided between the first heating portion 14 and the distal portion 12. The second shoulder 13 comprises a wall extending substantially radially outwardly from the first heating portion 14.

The second heating portion 15 has a width of about 5 mm and a length of about 25 mm. The first heating portion has a width of about 9 mm and a length of about 25 mm. The distal portion has a width of about 13 mm and a length of about 45 mm.

The first heating portion 14 comprises seven identical electric heaters 17. The seven electric heaters 17 are spaced evenly around the circumference of the outer surface of the first heating portion 14. Each of the electric heaters 17 is elongate and arranged with its length extending in the direction along a longitudinal axis A of the main unit 3. The length of each electric heater 17 is substantially similar to the length of the tubular first component 4 of the aerosol-generating article 2. As such, when the tubular first component 4 is received on the first heating portion 14 of the main unit 3, the tubular first component 4 overlaps and covers the electric heaters 17 of the first heating portion 14 along their entire length. This enables a substantial proportion of the heat produced by the heaters 17 to be transferred to the tubular aerosol-forming-substrate 6 of the tubular first component 4, rather than to ambient air during use of the aerosol-generating system 1.

The first heating portion 14 of the main unit 3 has a circularly-cylindrical cross-section that is substantially similar to the cross-section of the inner passage 7 of the tubular first component 4. The width of the first heating portion 14 is slightly larger than the width of the inner passage 7. As such, the first heating portion 14 of the main unit 3 may be received in the inner passage 7 of the tubular first component 4 with an interference or a friction fit. The interference or friction fit ensures contact between the electric heaters 17 at the outer surface of the first heating portion 14 and the inner surface of the inner passage 7 of the tubular first component 4, when the aerosol-generating article 2 is received by the main unit 3. This contact facilitates heat transfer between the heaters 17 and the tubular aerosol-forming substrate 5. The interference of friction fit also provides some resistance against movement of the tubular first component 4 along the longitudinal axis A of the main unit 3. As such, the interference or friction fit helps to retain the tubular first component 4 on the first heating portion 14 of the main unit 3.

The second heating portion 15 also comprises seven identical electric heaters 18, similar to the heaters 17 of the first heating portion 14. The length of each electric heater 18 is substantially similar to the length of the tubular second component 5 of the aerosol-generating article 2. As such, when the tubular second component 5 is received on the second heating portion 15, the tubular second component 5 overlaps and covers the electric heaters 18 of the second heating portion 15 along their entire length.

The second heating portion 15 has a circularly-cylindrical cross-section that is substantially similar to the cross-section of the inner passage 9 of the tubular second component 5. The width of the second heating portion 15 is slightly larger than the width of the inner passage 9. As such, the second heating portion 15 may be received in the inner passage 9 of the tubular second component 5 with an interference or a friction fit.

The distal portion 12 of the main unit 3 houses a rechargeable lithium ion battery 19 and electric circuitry 20 inside the hollow housing 10. The battery 19 is arranged and configured to supply power to the electric heaters 17, 18 of the first and second heating portions 14, 15. The electric circuitry 20 is configured to control the supply of power from the battery 19 to the electric heaters 17, 18. The electric circuitry also comprises a sensor (not shown) for detecting a user's puff on the aerosol-generating system 1.

The electric circuitry 20 is configured to supply power to the electric heaters 17 of the first heating portion 14 either simultaneously or individually in a predetermined sequence.

In other words, the electric circuitry is configured to supply power to the electric heaters 17 of the first heating portion 14 in different heating modes, such as a simultaneous heating mode and a sequential heating mode. Similarly, the electric circuitry 20 is configured to supply power to the electric heaters 18 of the second heating portion 15 either simultaneously or individually in a predetermined sequence. The electric circuitry is also configured to supply power to the electric heaters 17 of the first heating portion 14 and the electric heaters 18 of the second heating portion either simultaneously or individually in a predetermined sequence.

For example, in a simultaneous heating mode, the electric circuitry is configured to supply power to all of the heaters 17, 18 of the first and second heating portions 14, 15 when a puff is detected. In another example, in a sequential mode, the electric circuitry is configured to supply electrical power to a first one of the heaters 17 of the first heating portion when a first puff is detected, to supply electrical power a second one of the heaters 17 when a second puff is detected and to subsequently supply power to individual ones of the remaining heaters 17 of the first heating portion 14 and then to supply power to individual ones of the heaters 18 of the second heating portion, in sequence, for each detected puff until all of the heaters 17, 18 have been activated.

A push button 21 is also provided on the distal portion 12 of the main unit 3. The electric circuitry 20 is configured to switch between heating modes on depression of the push button 21. Consecutive depressions of the push button 21 switch the heating mode of the electric circuitry between sequential heating modes, simultaneous heating modes and a no power mode (off).

The aerosol-generating system 1 further comprises a mouthpiece 22 that is removably receivable on the main unit 3. The mouthpiece comprises a hollow, circularly cylindrical housing formed of the same material as the main unit 3. The mouthpiece 22 has substantially the same width as the distal portion 12 of the main unit 3, and comprises a cavity sized to receive the aerosol-generating article 2, when the aerosol-generating article 2 is received by the main unit 3. The mouthpiece 22 is removably coupled to the main unit 3 via a female screw thread (not shown) at the distal end of the housing of the mouthpiece 22 and a corresponding male screw thread (not shown) at the proximal end of the distal portion 12 of the main unit 3.

The cavity also forms an air passage 23 around the outer surfaces of the aerosol-generating article 2, when the aerosol-generating article 2 is received by the main unit 3. The air passage 23 is arranged to receive vapour generated by the heated aerosol-generating article 2.

A plurality of air inlets 24 are arranged at the distal end of the mouthpiece 22, and an air outlet 25 is provided at the tapered proximal end of the mouthpiece 22. The plurality of air inlets 24 and the air outlet 25 are fluidly connected to the air passage 23 to enable air to be drawn through the air passage 23 when a user draws on the mouthpiece 22.

To assemble the electrically operated aerosol-generating system 1 for use, a user arranges the aerosol-generating article 2, in the storage configuration, relative to the main unit 3, such that the proximal end of the main unit 3 faces either open end of the inner passages 7, 9 of the first and tubular second components 4, 5. The user aligns the central axis B of the main unit 3 with the central axis A of the aerosol-generating component 2, and moves the main unit 3 towards the aerosol-generating article 2 along the common central axis. The user inserts the proximal end of the main unit 3 into the inner passage 9 of the tubular second component 5, and slides the main unit 3 through the inner passage 9 until the tubular second component 5 abuts the first shoulder 16. In this position, the tubular second component 5 is fully received on the second heating portion 15. The user continues to move the main unit 3 along the common axis and the first shoulder 16 pushes the tubular second component 5 through the inner passage 7 of the tubular first component 4. The user continues to move the main unit along the common axis until the second shoulder 13 abuts the distal end of the tubular first component 4. In this position, the tubular first component 4 is fully received on the first heating portion 14 of the main unit 3.

In use, the user depresses the push button 21 to switch the main unit 3 from the off mode into the sequential heating mode. The user draws on the mouthpiece 22 of the main unit 3, and the electric circuitry 20 detects the user's puff on the mouthpiece 22. On detection of the user's puff, the electric circuitry 20 supplies power from the power supply 19 to one of the electric heaters 17 of the first heating portion 14. The powered electric heater 17 heats a portion of the tubular aerosol-forming substrate 6 of the tubular first component 4. As the portion of the aerosol-forming substrate 6 is heated, volatile compounds of the aerosol-forming substrate 6 vapourise and generating a vapour.

Figure 6:
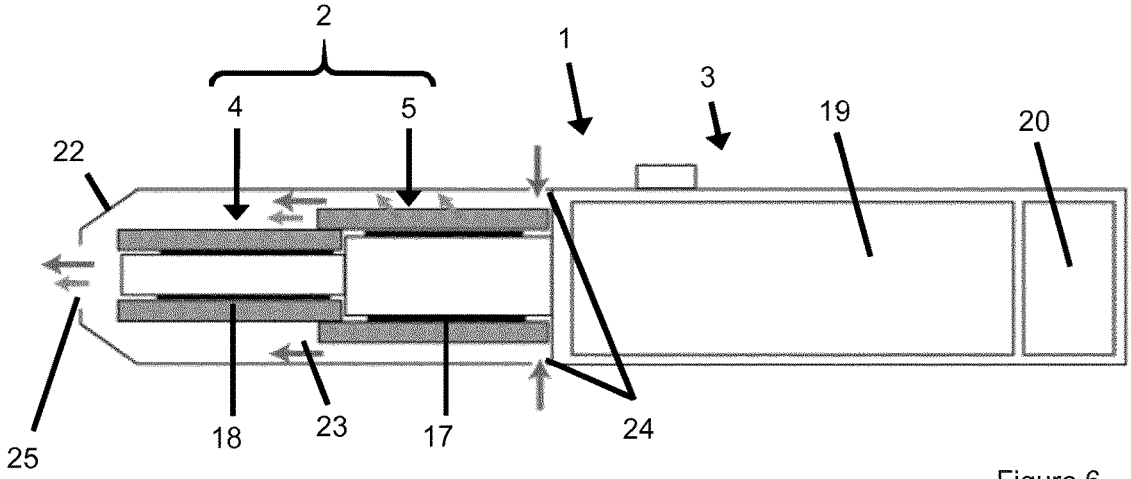
FIG. 6 is a schematic illustration of the aerosol-generating system of FIG. 1, showing airflow through the aerosol-generating system when a user draws on the mouthpiece.

When the user draws on the mouthpiece 22 of the main unit 3, ambient air is drawn into the aerosol-generating system 1 through the air inlets 24 in the mouthpiece 22. The air is drawn over the outer surface of the aerosol-generating article 2, through the air passage 23 and entrains vapour from the heated aerosol-forming substrate 6. The entrained vapour is drawn through the air passage 23 towards the air outlet 25 and cools to form an aerosol. The aerosol is drawn out of the air passage 23 through the air outlet 25, and is delivered to the user for inhalation. The direction of airflow through the system 1 is indicated by the arrows shown in FIG. 6.

Figure 7:
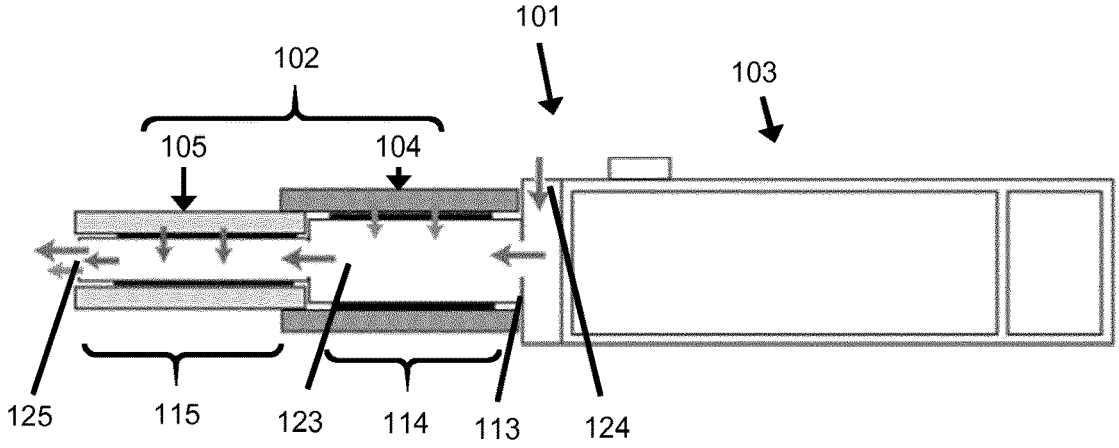
FIG. 7 is a schematic illustration of an aerosol-generating system according to a second embodiment of the present invention, showing airflow through the aerosol-generating system when a user draws on the mouthpiece.

FIG. 7 shows an electrically operated aerosol-generating system 101 according to a second embodiment of the present invention. The electrically operated aerosol-generating system 101 comprises an aerosol-generating article 102 and a main unit 103. The aerosol-generating article 102 and the main unit 103 are substantially similar to the aerosol-generating article 2 and the main unit 3 described above in relation to FIGS. 1 to 6, and where the same features are present like reference numerals have been used to refer to these features.

The aerosol-generating article 102 differs from the aerosol-generating article 2 of FIGS. 1 to 6 in that the outer wrappers (not shown) circumscribing the first and tubular second components 104, 105 are comprises of a substantially air impermeable material. The substantially air impermeable wrappers substantially prevent or inhibit the release of vapour from the cylindrical outer surfaces of the heated first and second components 104, 105.

The main unit 103 differs from the main unit 3 of FIGS. 1 to 6 in that the main unit 103 comprises an air passage 123 extending through the first and second heating portions 114, 115 of the main unit 103. The main unit 103 further comprises a plurality of air inlets (not shown) in the first heating portion 114 and a plurality of air inlets (not shown) in the second heating portion 115. The air inlets in the first and second heating portions are arranged in the spaces between the electric heaters and are configured to enable vapour from the heated aerosol-forming substrate in the first and tubular second components 104, 105 to be drawn into the air passage 123. The main unit 103 further comprises an additional air inlet 124 at the second shoulder 113, between the distal portion and the first heating portion 114, and an air outlet 125 and the proximal end. The additional air inlet 124 enables ambient air to be drawn directly into the air passage 123, to facilitate cooling of the vapour from the heated aerosol-forming substrate. An air outlet 125 is also provided at the proximal end of the main unit. The air outlet 125 and the air inlets enable air and vapour to be drawn into and through the air passage 123 when a user draws on the mouth end of the main unit 103.

In use, when a user draws on the mouth end of the main unit 103, ambient air is drawn into the first and second components 104, 105 of the aerosol-generating article at the annular end faces. The air entrains vapour from the heated aerosol-forming substrate and draws the entrained vapour to the inner surfaces of the inner passages of the components 104, 105. The entrained vapour is drawn into the air passage 123 at the air inlets in the first and second heating portions 114, 115. Ambient air is also drawn directly into the air passage 123 at the additional air inlet 124. The ambient air mixes with the vapour in the air passage 123, and the vapour cools to form an aerosol. The aerosol is drawn through the air passage 123 towards the mouth end, and is drawn out of the air passage 123 at the air outlet 125 where it is delivered to the user. The direction of airflow through the system 101 is indicated by the arrows shown in FIG. 7.

Figure 8:
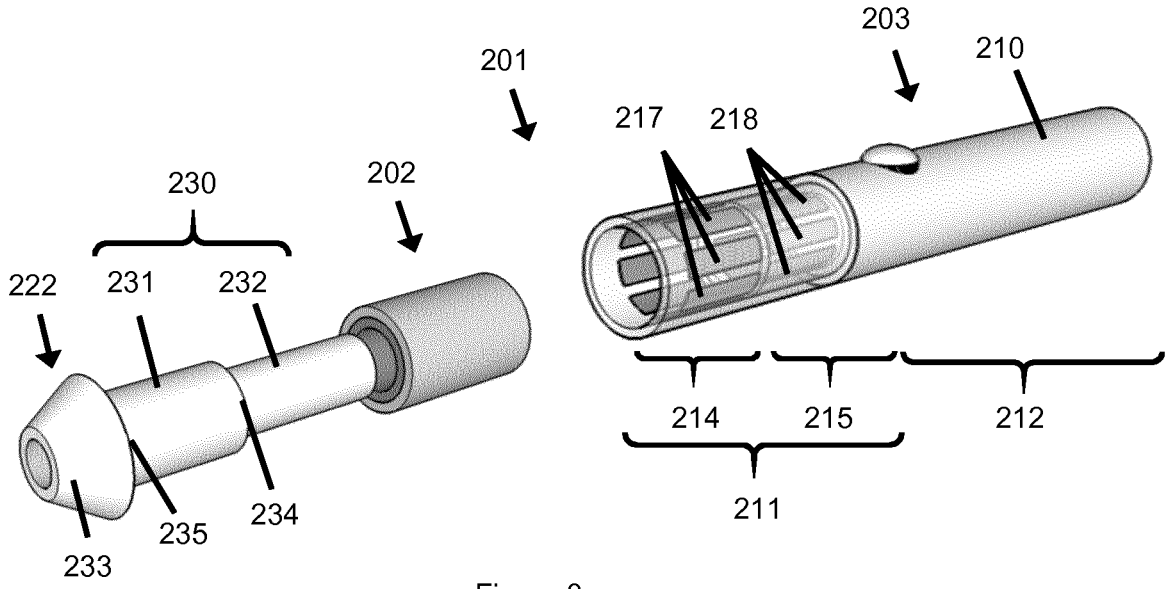
FIG. 8 is a schematic illustration of an electrically operated aerosol-generating system according to a third embodiment of the present invention.
Figure 9:
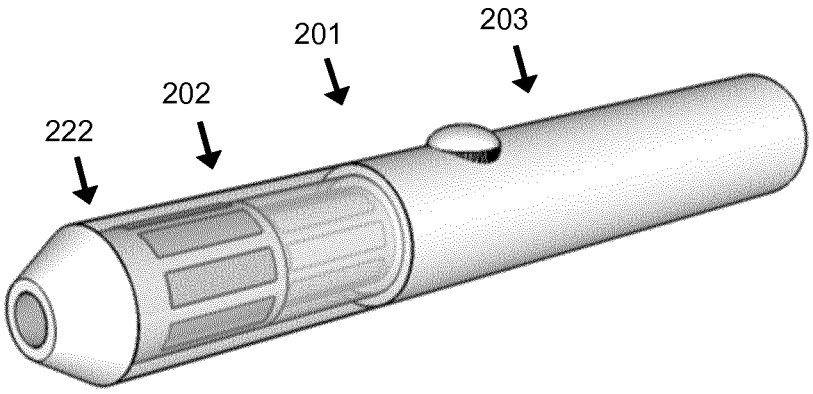
FIG. 9 is a schematic illustration of the electrically operated aerosol-generating system of FIG. 8, showing the system assembled for use.
Figure 10:
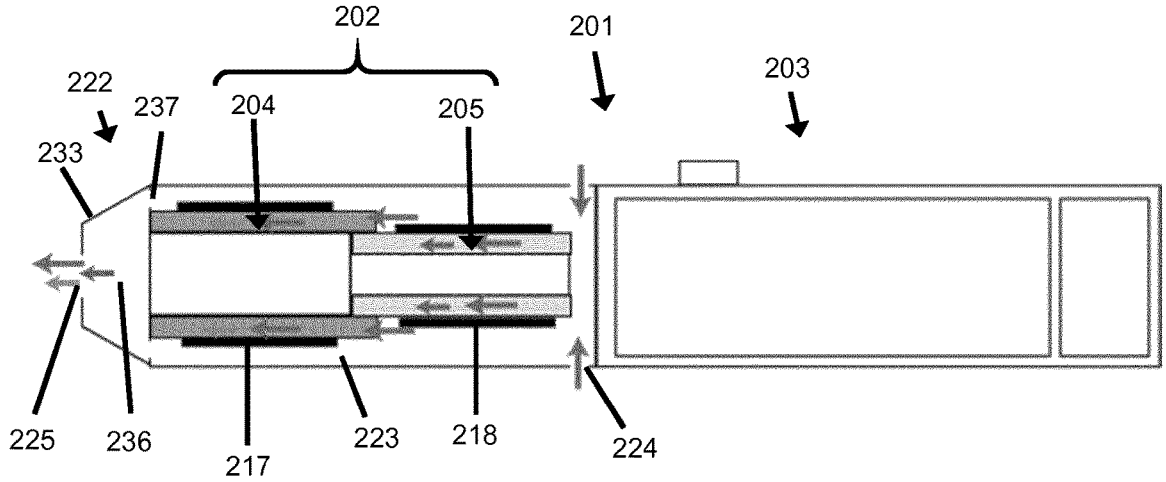
FIG. 10 is a schematic illustration of the electrically operated aerosol-generating system of FIG. 8, showing airflow through the aerosol-generating system when a user draws on the mouthpiece.

An electrically operated aerosol-generating system according to a third embodiment of the present invention is shown in FIGS. 8 to 10. The electrically operated aerosol-generating system 201 comprises an aerosol-generating article 202 and a main unit 203.

The aerosol-generating article 202 is substantially identical to the aerosol-generating article 1 described above in relation to FIGS. 1 to 6, and where the same features are present like reference numerals have been used to refer to these features. The aerosol-generating article 202 comprises a tubular first component 204 and a tubular second component 205. The tubular first component 204 comprises a tubular aerosol-forming substrate and a substantially air permeable wrapper (not shown). Similarly, the tubular second component 205 comprises a tubular aerosol-forming substrate and a substantially air permeable wrapper (not shown).

The main unit 203 comprises a substantially circularly-cylindrical hollow housing 210 formed of a rigid, thermally insulating material, such as PEEK. The main unit 203 comprises a proximal portion 211 and a distal portion 212.

The proximal portion 211 comprises a housing 210 having a cavity with an open proximal end. A plurality of air inlets 224 are provided in the housing 210 at the distal end of the proximal portion 211, such that ambient air may be drawn into the cavity of the proximal portion 211.

A first heating portion 214 and a second heating portion 215 extend over portions of the inner surface of the cavity of the proximal portion 211. The first heating portion 214 is arranged at the proximal end of the cavity, and the second heating portion 215 is arranged between the first heating portion 214 and the distal portion 212, at the distal end of the cavity. The first heating portion 214, second heating portion 215 and distal portion 212 are coaxially arranged along a common axis.

The width of the first heating portion 214 is substantially similar to the width of the tubular first component 204, such that the first heating portion 214 is in close proximity to the outer surface of the tubular second component 205, when the aerosol-generating article 202 is received by the main unit 203. Similarly, the width of the second heating portion 215 is substantially similar to the width of the tubular second component 205 such that the second heating portion 215 is in close proximity to the outer surface of the tubular second component 205, when the aerosol-generating article 202 is received by the main unit 203.

The first heating portion 214 comprises seven identical electric heaters 217. The seven electric heaters 217 are spaced evenly around the circumference of the first heating portion 214. Each of the electric heaters 217 is elongate and arranged with its length extending in the direction along a longitudinal axis of the main unit 203. The length of each electric heater 217 is substantially similar to the length of the tubular first component 204 of the aerosol-generating article 202.

The second heating portion 215 also comprises seven identical electric heaters 218. The seven electric heaters 218 are spaced evenly around the circumference of the second heating portion 215. Each of the electric heaters 218 is elongate and arranged with its length extending in the direction along a longitudinal axis of the main unit 203. The length of each electric heater 218 is substantially similar to the length of the tubular second component 205 of the aerosol-generating article 202.

The distal portion 212 of the main unit 203 is substantially identical to the distal portion of the main unit 1 described above in relation to FIGS. 1 to 6, and where the same features are present like reference numerals have been used to refer to these features. The distal portion 212 houses a battery, electric circuitry and a push button switch as described above in relation to FIGS. 1 to 6.

The aerosol-generating system 201 further comprises a mouthpiece 222 that is removably couplable to the main unit 203. The mouthpiece 222 is comprised of the same material as the housing 210 of the main unit 203.

The mouthpiece 222 comprises a substantially circularly cylindrical receiving member 230 comprising a first portion 231 and a second portion 232. The mouthpiece 222 further comprises a tapered mouth end 233 for a user to draw on, comprising an air outlet 225. The tapered mouth end 233, the first portion 231 and the second portion 232 are coaxially arranged on a common axis The first portion 231 of the receiving member 230 has a circularly-cylindrical cross-section that is substantially similar to the cross-section of the inner passage of the tubular first component 204.

The second portion 232 of the receiving member 230 has a circularly-cylindrical cross-section that is substantially similar to the cross-section of the inner passage of the tubular second component 205. The width of the second portion 232 is less than the width of the first portion 231 of the receiving member 230. As such, a shoulder 234 is provided between the first heating portion 214 and the second heating portion 215.

The tapered end 233 of the mouthpiece 222 comprises a distal end 235 that has substantially the same width as the housing 210 of the proximal portion 211 of the main unit 203. A male bayonet connector (not shown) is provided at the distal end 235 of the tapered mouth end 233. The male bayonet connector is engageable with a female bayonet connector (not shown) at the proximal end of the housing 210 of the proximal portion 211 of the main unit 203 for removably coupling the mouthpiece 222 to the main unit 203.

FIG. 10 shows the electrically operated aerosol-generating system 201 assembled for use. As shown in FIG. 10, when the mouthpiece 222 is removably coupled to the main unit 203 with the aerosol-generating article 202 received on the mouthpiece 222, the cavity of the proximal portion 211 of the main unit 203 forms an air passage 223 around the aerosol-generating article 202.

The tapered end 233 of the mouthpiece 222 comprises a cavity 26 for cooling vapour generated by the heated aerosol-generating article 202 before delivery to a user through the air outlet 225. The distal end 235 of the tapered end comprises a plurality of openings 237 that enable fluid communication between the air passage 223 of the main unit 203 and the chamber 236 of the mouthpiece, when the mouthpiece is removably coupled to the main unit 203.

To assemble the electrically operated aerosol-generating system 201 for use, a user first inserts the receiving member 230 of the mouthpiece 222 into the aerosol-generating component 204. The user arranges the aerosol-generating article 202, in the storage configuration, relative to the mouthpiece 222, such that the distal end of the receiving portion 230 of the mouthpiece 222 faces either open end of the inner passages of the first and tubular second components 204, 205. The user aligns the central axis of the mouthpiece 222 with the central axis of the aerosol-generating component 202, and moves the mouthpiece 222 towards the aerosol-generating article 202 along the common central axis. The user inserts the distal end of the mouthpiece 222 into the inner passage of the tubular second component 205, and slides the mouthpiece 222 through the inner passage until the tubular second component 205 abuts the shoulder 234. In this position, the tubular second component 205 is fully received on the second portion 232 of the receiving member 230. The user continues to move the mouthpiece 222 along the common axis and the shoulder 234 pushes the tubular second component 205 through the inner passage of the tubular first component 204. The user continues to move the main unit along the common axis until the distal end 235 of the tapered end 233 abuts the proximal end of the tubular first component 204. In this position, the tubular first component 204 is fully received on the first portion 231 of the mouthpiece 222.

The user then removably couples the mouthpiece 222 to the main unit 203 with the aerosol-generating article 202 received on the mouthpiece 222.

In use, the user depresses the push button 221 to switch the main unit 203 from the off mode into the sequential heating mode. The electric circuitry of the main unit is configured to operate as described above in relation to FIGS. 1 to 6.

When the user draws on the mouthpiece 222, ambient air is drawn into the aerosol-generating system 201 through the air inlets 224 at the distal end of the proximal portion 212 of the main unit 203. The air is drawn through the air passage 223 in the cavity and through the first and second components 204, 205 of the aerosol-generating article 202. Vapour generated by the heated aerosol-forming substrate of the aerosol-generating article 202 is entrained in the air drawn through the aerosol-generating article 202 and is drawn out of the aerosol-generating article 202 into the air passage 223 of the proximal portion of the main unit 203. The entrained vapour is drawn through the air passage 223 of the main unit 203 and into the chamber 236 of the tapered end 223 of the mouthpiece 222 through the air inlets 237. The vapour cools in the chamber 236 to form an aerosol, and the aerosol is drawn out of the chamber 236 at the air outlet 225 and is delivered to the user for inhalation. The direction of airflow through the system 201 is indicated by the arrows shown in FIG. 10.

It will be appreciated that additional components may be provided in the chamber 236 of the tapered end 222 of the mouthpiece. The additional components may comprise one or more of a mouthpiece filter and a cooling element.

Figure 11:
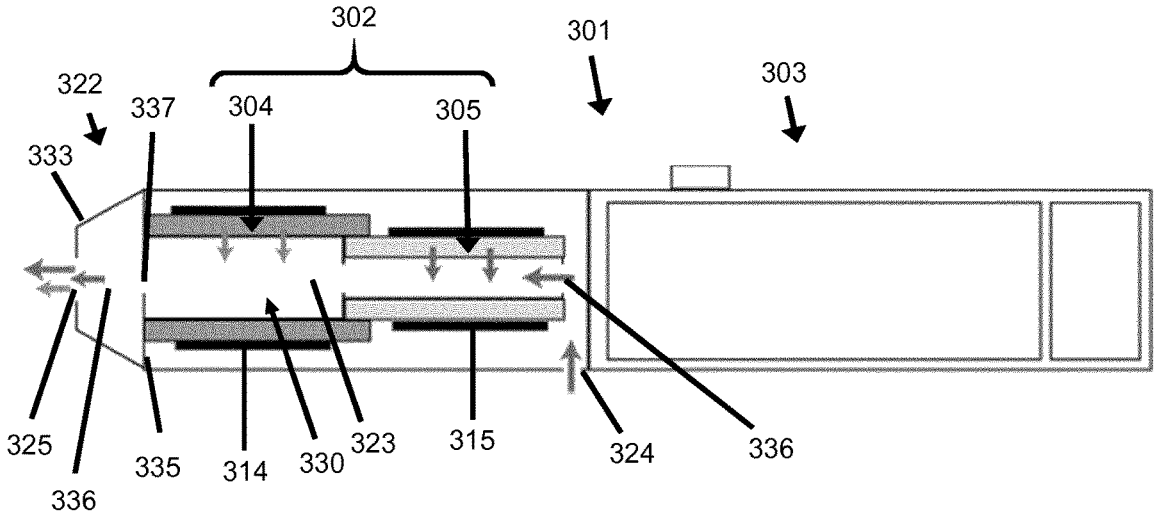
FIG. 11 is a schematic illustration of an electrically operated aerosol-generating system according to a fourth embodiment of the present invention, showing airflow through the aerosol-generating system when a user draws on the mouthpiece.

FIG. 11 shows an electrically operated aerosol-generating system 301 according to a fourth embodiment of the present invention. The electrically operated aerosol-generating system 301 comprises an aerosol-generating article 302 and a main unit 303. The aerosol-generating article 302 and the main unit 303 are identical to the aerosol-generating article 202 and the main unit 203 described above in relation to FIGS. 8 to 10, and where the same features are present like reference numerals have been used to refer to these features.

The aerosol-generating article 302 comprises a tubular first component 304 and a tubular second component 305. The main unit 303 comprises a proximal portion having a first heating portion 314 at an inner surface of the proximal portion and a second heating portion 315 at an inner surface of the proximal portion.

The mouthpiece 322 is similar to the mouthpiece 222 of FIGS. 8 to 10, but differs in that the receiving member 330 is hollow and comprises an air passage 323. The receiving member 330 further comprises a plurality of air inlets (not shown) in the first portion and a plurality of air inlets (not shown) in the second portion. The air inlets in the first and second portions of the receiving member 330 are configured to be covered by the first and tubular second components 304, 305 of the aerosol-generating article 302 when the aerosol-generating article is received by the mouthpiece 322. The air inlets in the first and second portions of the receiving member 330 enable vapour from the heated aerosol-forming substrate in the first and tubular second components 304, 305 to be drawn into the air passage 323 of the receiving member 330.

The mouthpiece 322 further comprises an additional air inlet 336 at the distal end of the receiving member. The additional air inlet 336 enables ambient air to be drawn directly into the air passage 323 from the cavity of the proximal portion of the main unit 302. This ambient air facilitates cooling of the vapour from the heated aerosol-forming substrate in the air passage 323.

The air passage 323 in the receiving member is connected to the chamber 326 in the tapered end 333 by a central aperture 337 in the distal end 335 of the tapered end 333. An air outlet 325 is also provided at the proximal end of the mouthpiece 333. The air outlet 325 and the air inlets enable air and vapour to be drawn into and through the air passage 323 when a user draws on the mouth end of the main unit 103.

In use, when a user draws on the mouthpiece 322, ambient air is drawn into the cavity of the proximal portion of the main unit 303 through one or more air inlets 324. The air is drawn through the cavity and into the aerosol-generating article 302 through both the annular end faces and the cylindrical outer faces. Vapour generated by the heated aerosol-forming substrate is entrained in the air and is drawn through the aerosol-generating article to the inner surfaces of the inner passages of the components 304, 305. The vapour is drawn into the air passage 323 in the receiving member 330 of the mouthpiece 322 through the air inlets in the first and second portions of the receiving member 330. Air is also drawn directly from the chamber in the proximal portion of the main unit 303 into the air passage 323 in the receiving member 330 through the additional air inlet 336 at the proximal end of the receiving member 330. The air mixes with the vapour from the heated aerosol-generating article and cools the vapour so that it forms an aerosol. The aerosol is drawn out of the air passage 232 into the chamber 336 in the tapered end 333 of the mouthpiece 322 through the central aperture 337. The aerosol is drawn out of the chamber 337 through the air outlet 325 and is delivered to the user for inhalation. The direction of airflow through the system 301 is indicated by the arrows shown in FIG. 11.

It will be appreciated that the examples described herein are straightforward examples, and that modifications may be made to the illustrated circuits to provide different or more sophisticated functionality. It will be appreciated that features described herein with reference to one embodiment may be applied to other embodiments without departing from the scope of the invention.

For example, the tubular first component may comprise a first aerosol-forming substrate and the tubular second component may comprise a second aerosol-forming substrate having a different composition to the first aerosol-forming substrate.

For example, the first component may comprise a first volatile substrate comprising a constituent part of an aerosol-forming substrate and the second component may comprise a second volatile substrate comprising another constituent part of the aerosol-forming substrate.

For example, the second component may not be a tubular component. Where the second component is not a tubular component, the second heating portion is arranged at an inner surface of the main unit.

The invention claimed is:

1. An electrically operated aerosol-generating system, comprising:

an aerosol-generating article comprising:

a tubular first component comprising a tubular first volatile substrate and an inner passage;

a second component comprising a second volatile substrate, the second component being configured to be received in the inner passage of the tubular first component; and a main unit configured to receive the aerosol-generating article, the main unit comprising:

a first heating portion comprising one or more electric heaters, the one or more electric heaters being configured to heat the tubular first volatile substrate of the tubular first component when the aerosol-generating article is received by the main unit; and a second heating portion comprising one or more electric heaters, the one or more electric heaters being configured to heat the second volatile substrate of the second component when the aerosol-generating article is received by the main unit.

2. The electrically operated aerosol-generating system according to claim 1, wherein the second component is further configured to be movably received in the inner passage of the tubular first component.

3. The electrically operated aerosol-generating system according to claim 2, wherein the main unit is further configured to engage with the second component of the article when the article is received by the main unit such that the second component is moved relative to the tubular first component to locate the tubular first component adjacent to the first heating portion and the second component adjacent to the second heating portion.

4. The electrically operated aerosol-generating system according to claim 1, wherein the main unit further comprises a mouth end and a distal end, and the first heating portion and the second heating portion are coaxially aligned between the mouth end and the distal end.

5. The electrically operated aerosol-generating system according to claim 1, wherein either:

the first heating portion of the main unit is disposed at an outer surface of the main unit and the inner passage of the tubular first component is configured to receive the first heating portion of the main unit, the one or more electric heaters of the first heating portion being further configured to heat an inner surface of the tubular first component when the aerosol-generating article is received by the main unit, or the first heating portion of the main unit is disposed at an inner surface of the main unit such that the one or more electric heaters of the first heating portion are configured to heat an outer surface of the tubular first component when the aerosol-generating article is received by the main unit.

6. The electrically operated aerosol-generating system according to claim 1, wherein the second heating portion of the main unit is disposed at an inner surface of the main unit such that the one or more electric heaters of the second heating portion are configured to heat an outer surface of the second component when the aerosol-generating article is received by the main unit.

7. The electrically operated aerosol-generating system according to claim 1, wherein the second component of the aerosol-generating article is a tubular component comprising a tubular second volatile substrate and an inner passage.

8. The electrically operated aerosol-generating system according to claim 7, wherein the tubular first component and the tubular second component are arranged such that the inner passage of the tubular first component is coaxially aligned with the inner passage of the tubular second component.

9. The electrically operated aerosol-generating system according to claim 7, wherein:

the first heating portion of the main unit is disposed at an outer surface of the main unit and the inner passage of the tubular first component is configured to receive the first heating portion of the main unit, such that the one or more electric heaters of the first heating portion are further configured to heat an inner surface of the tubular first component when the aerosol-generating article is received by the main unit, and the second heating portion of the main unit is disposed at an outer surface of the main unit and the inner passage of the tubular second component is configured to receive the second heating portion of the main unit, such that the one or more electric heaters of the second heating portion are further configured to heat an inner surface of the second component when the aerosol-generating article is received by the main unit.

10. The electrically operated aerosol-generating system according to claim 9, wherein the system further comprises a mouthpiece removably couplable to the main unit, the mouthpiece comprising a housing having a cavity configured to receive the tubular first component and the tubular second component when the aerosol-generating article is received by the main unit and the mouthpiece is coupled to the main unit.

11. The electrically operated aerosol-generating system according to claim 7, wherein:

the first heating portion of the main unit is disposed at an inner surface of the main unit such that the one or more electric heaters of the first heating portion are further configured to heat an outer surface of the tubular first component when the aerosol-generating article is received by the main unit, and the second heating portion of the main unit is disposed at an inner surface of the main unit such that the one or more electric heaters of the second heating portion are further configured to heat an outer surface of the second component when the aerosol-generating article is received by the main unit.

12. The electrically operated aerosol-generating system according to claim 11, wherein the system further comprises a mouthpiece removably couplable to the main unit, the mouthpiece comprising a receiving member, and wherein the inner passage of the tubular first component is configured to receive a first portion of the receiving member of the mouthpiece and the inner passage of the tubular second component is configured to receive a second portion of the receiving member of the mouthpiece.

13. The electrically operated aerosol-generating system according to claim 1, wherein:

the first volatile substrate comprises a first aerosol-forming substrate, or the second volatile substrate comprises a second aerosol-forming substrate, or the first volatile substrate comprises a first aerosol-forming substrate and the second volatile substrate comprises a second aerosol-forming substrate.

14. The electrically operated aerosol-generating system according to claim 1, wherein the first volatile substrate comprises a first component of an aerosol-forming substrate and the second volatile substrate comprises a second component of the aerosol-forming substrate.

15. An aerosol-generating article for an electrically operated aerosol-generating system according to claim 1, the aerosol-generating article comprising:

a tubular first component comprising a first volatile substrate and an inner passage; and a second component comprising a second volatile substrate, the second component being configured to be received in the inner passage of the tubular first component.

* * * * *